US007849940B2

(12) United States Patent
Wilde et al.

(10) Patent No.: US 7,849,940 B2
(45) Date of Patent: Dec. 14, 2010

(54) DRILL BIT HAVING THE ABILITY TO DRILL VERTICALLY AND LATERALLY

(75) Inventors: David Wilde, Houston, TX (US); James Shamburger, Spring, TX (US)

(73) Assignee: Omni IP Ltd., Road Town, Tortola (VG)

( * ) Notice: Subject to any disclaimer, the term of this patent is extended or adjusted under 35 U.S.C. 154(b) by 0 days.

(21) Appl. No.: 12/215,435

(22) Filed: Jun. 27, 2008

(65) Prior Publication Data

US 2009/0321137 A1 Dec. 31, 2009

(51) Int. Cl.
*E21B 7/04* (2006.01)
*E21B 7/08* (2006.01)

(52) U.S. Cl. ..... 175/408; 175/61; 175/415

(58) Field of Classification Search ..... 175/61, 175/408, 415, 385
See application file for complete search history.

(56) References Cited

U.S. PATENT DOCUMENTS

| | | | | |
|---|---|---|---|---|
| 5,004,057 | A * | 4/1991 | Tibbitts et al. | 175/408 |
| 5,467,836 | A | 11/1995 | Grimes et al. | |
| 5,740,873 | A | 4/1998 | Tibbitts | |
| 6,123,160 | A | 9/2000 | Tibbitts | |
| 6,206,117 | B1 | 3/2001 | Tibbitts et al. | |
| 6,260,636 | B1 | 7/2001 | Cooley et al. | |
| 6,349,780 | B1 * | 2/2002 | Beuershausen | 175/408 |
| 6,427,792 | B1 | 8/2002 | Roberts et al. | |
| 6,474,425 | B1 | 11/2002 | Truax et al. | |
| 6,484,825 | B2 | 11/2002 | Watson et al. | |
| 6,659,207 | B2 | 12/2003 | Hoffmaster et al. | |
| 6,684,967 | B2 | 2/2004 | Mensa-Wilmot et al. | |
| 7,457,734 | B2 | 11/2008 | Johnson et al. | |
| 2002/0020565 | A1 | 2/2002 | Hart et al. | |
| 2005/0273302 | A1 | 12/2005 | Huang et al. | |
| 2006/0037785 | A1 | 2/2006 | Watson et al. | |
| 2007/0205023 | A1 | 9/2007 | Hoffmaster et al. | |
| 2007/0272446 | A1 | 11/2007 | Mensa-Wilmot | |
| 2008/0142271 | A1 | 6/2008 | Brackin et al. | |

FOREIGN PATENT DOCUMENTS

| | | |
|---|---|---|
| WO | WO 99/13194 | 3/1999 |
| WO | WO 00/43628 | 7/2000 |

* cited by examiner

*Primary Examiner*—Giovanna C Wright
(74) *Attorney, Agent, or Firm*—The Matthews Firm

(57) ABSTRACT

A drill bit having a plurality of cutters on its lower surface, each of which can having a plurality of PDC cutter elements disposed thereon. The cutting surface on each of the cutters is mounted in in an orientation that allows drilling of oversize boreholes which enables the drill bit to be turned more easily to facilitate the boreholes being drilled on a smaller radius. The placement of the cutters on each of the blades enables the drill bit to drill both vertically and laterally.

19 Claims, 8 Drawing Sheets

DRILL BIT HAVING THE ABILITY TO DRILL VERTICALLY AND LATERALLY

BACKGROUND OF INVENTION

This invention relates generally to drill bits used in drilling oil and gas wells. Drill bits in general are well known in the art. In recent years a good number of bits have been designed using blades with affixed PDC cutter elements as cutting or shearing elements. The cutting elements or cutters are mounted on a rotary bit and oriented so that each of the PDC cutters engages the rock face at a desired angle. The bit is typically cleaned and cooled during drilling of the flow of drilling fluid (sometimes referred to as mud) out of one or more nozzles on the bit face. The drilling fluid is pumped down the drill string, flows across the bit face, removing cuttings and cooling the bit, and then flows back to the surface through the annulus between the drill string and the borehole wall.

It has been common practice in the drill bit industry to include gage wear pads on the outer surface of the drill bit which is at the diameter of the bit and establishes the drill bit's size. Thus, an 8" bit will have the gage at approximately 4" from the center of the bit.

A drill bit known in the prior art is shown in FIG. 1. Bit 10 is a fixed cutter bit adapted for drilling through formations of rock to form a borehole. Bit 10 generally includes a bit body having shank 13, and a threaded connection or pin 16 for connecting bit 10 to a drill string (not shown) which is employed to rotate the bit for drilling the borehole. Bit 10 further includes a central axis 11 and a cutting structure on the face 14 of the drill bit, preferably including blades with affixed PDC cutter elements 40. Also shown in FIG. 1 is a gage pad 12, the outer surface of which is at the diameter of the bit and establishes the bit's size. Thus, a 12" bit will have the gage pad at approximately 6" from the center of the bit.

As best shown in FIG. 2, illustrating in a different view the drill bit of FIG. 1, the drill bit 10 includes a face region 14 and a gage pad region 12 for the drill bit. The face region 14 includes a plurality of cutting elements 40 from a plurality of blades, shown overlapping in rotated profile. The action of cutter elements 40 drills the borehole while the drill bit body 10 rotates. Downwardly extending flow passages 21 have nozzles or ports 22 disposed at their lowermost ends. Bit 10 includes six such flow passages 21 and nozzles 22. The flow passages 21 are in fluid communication with central bore 17. Together, passages 21 and nozzles 22 serve to distribute drilling fluids around the cutter elements 40 for flushing formation cuttings from the bottom of the borehole and away from the cutting faces of cutter elements 40 when drilling.

However, the Applicant has discovered that it can be very advantageous, especially in the drilling of highly deviated wellbores, that the borehole be drilled overgage, making it easier for making sharper turns in the borehole than could be easily accomplished when drilling at the gage of the drill bit. Accordingly, the Applicant has discovered that it would be advantageous to make drill bits in which the ability to drill overgate is not inhibited by gage wear pads, or other dedicated gage retention mechanisms. Moreover, PDC cutter elements may be installed in a longer, continuous path which goes nearly to the shank of the bit, and well past the point typically located in the prior art, as is described in detail hereinafter.

DETAILED DESCRIPTION OF THE PREFERRED EMBODIMENTS OF THE INVENTION

Figure 3:
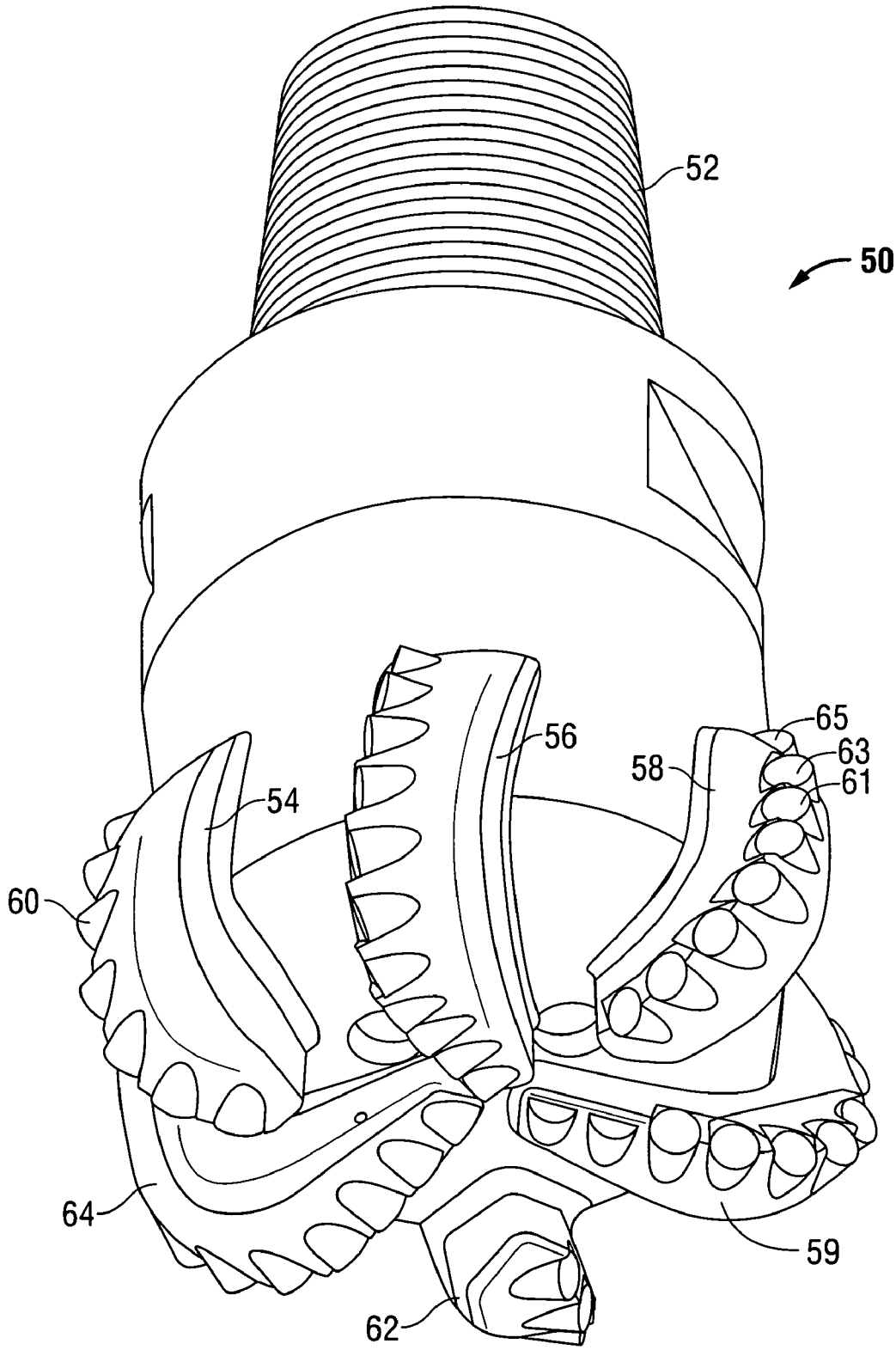
FIG. 3 is a pictorial view of a drill bit according to an embodiment of the present invention.

FIG. 3 is a pictorial illustration of a drill bit 50 according to a preferred embodiment of the present invention. The bit 50 has no gage wear pads or any other dedicated gage retention mechanism. The drill bit 50 has a threaded pin end 52 for threadedly engaging the drill string (not illustrated). The plurality of blades 54, 56 and 58, as well as the other similar blades on the other side of the bit but which are not visible in this drawing figure. Each of the plurality of blades is adapted for extending the borehole by cutting into the earth and may be used in combination with cutter elements of any suitable material affixed thereon, preferably including PDC cutter elements, such as those bearing the numeral 60 in FIG. 3.

Figure 4:
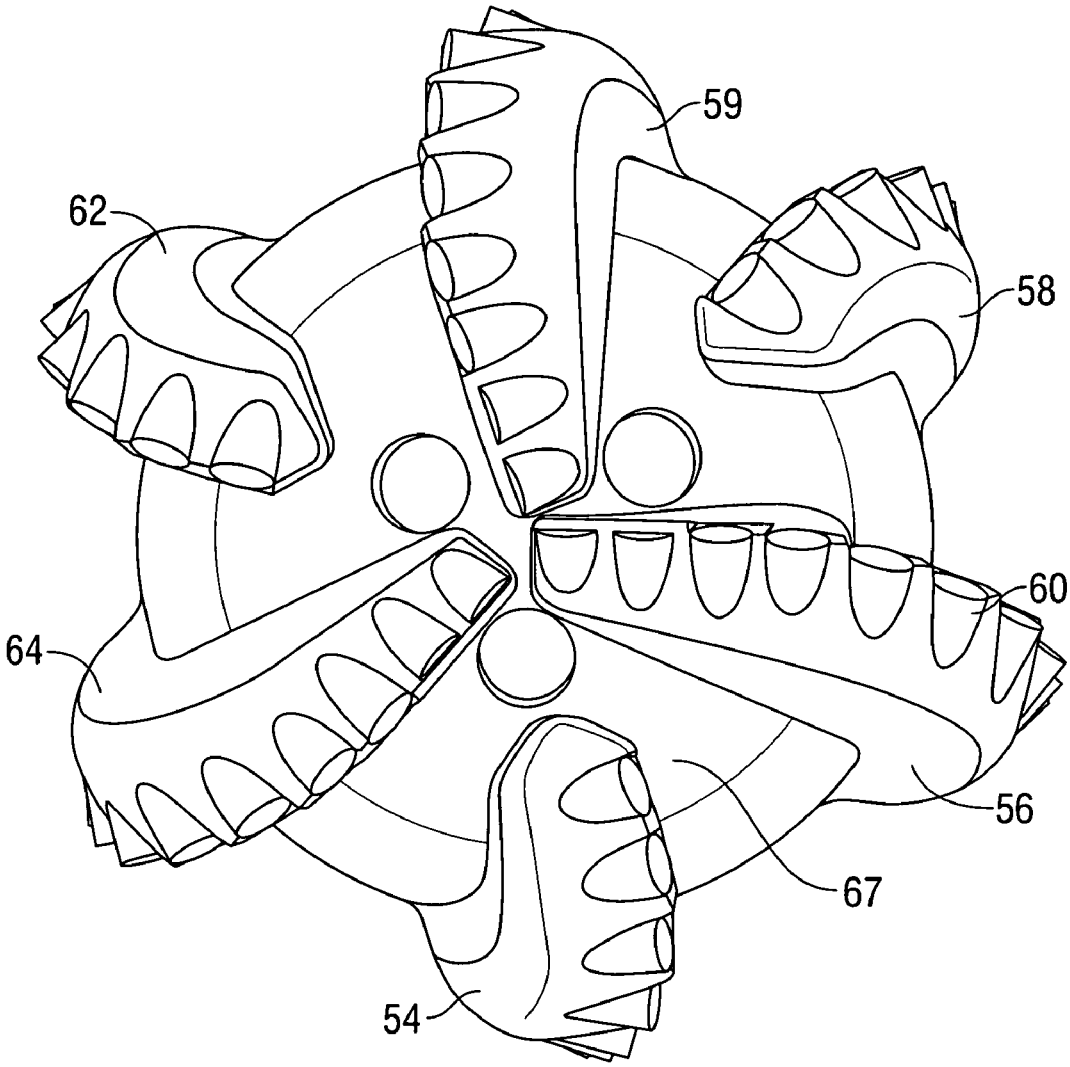
FIG. 4 is another pictorial, bottom view of the drill bit according to FIG. 3.

The same bit as is illustrated in FIG. 3 is illustrated with a bottom view in FIG. 4, illustrating six blades which include the blades 54, 56 and 58, and which also include the blades 59, 62, and 64 which are not visible in illustration in FIG. 3.

Figure 1:
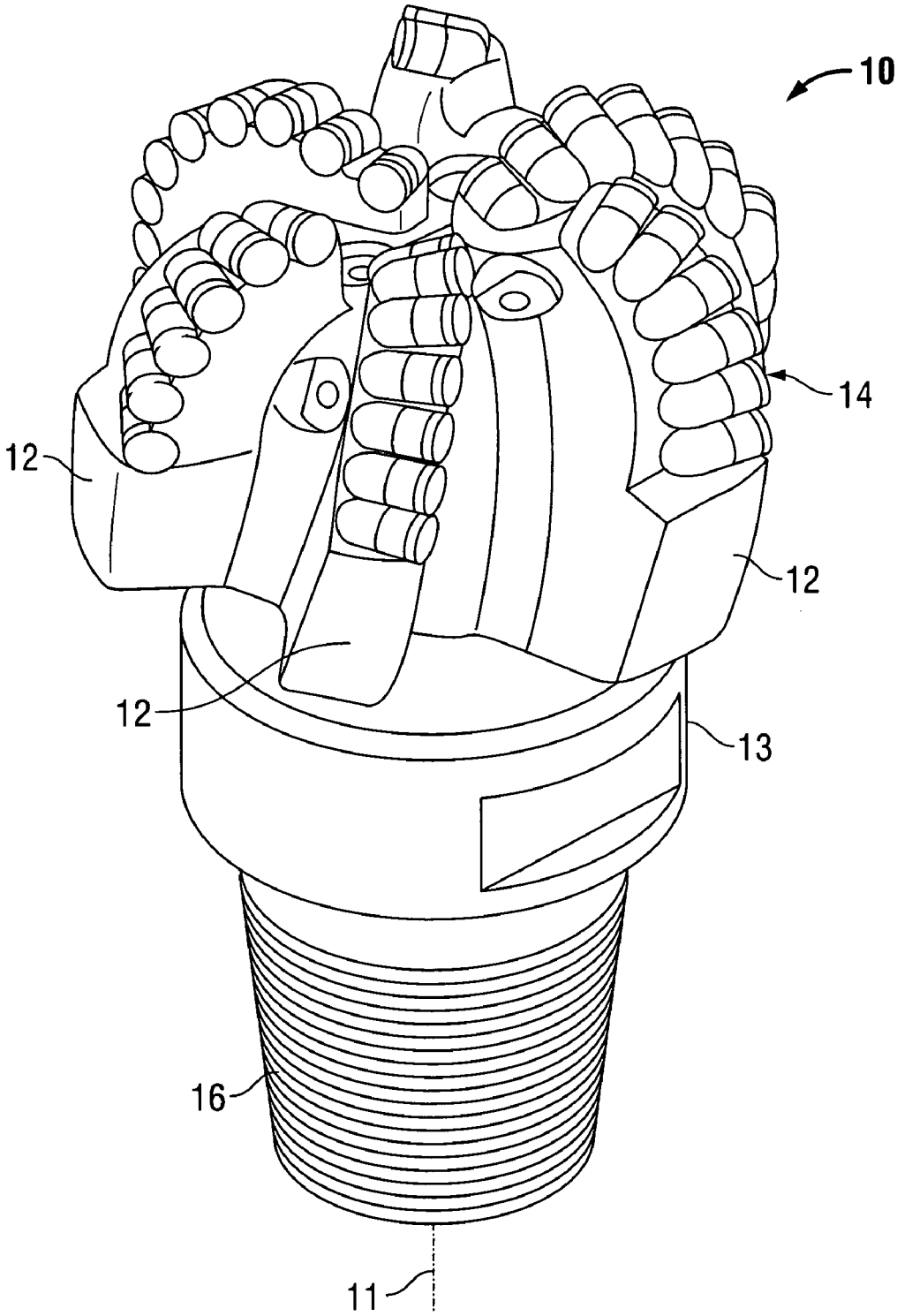
FIG. 1 (Prior Art)
FIG. 1 is a pictorial illustration of a drill bit known in the prior art using a plurality of gage wear pads.
Figure 2:
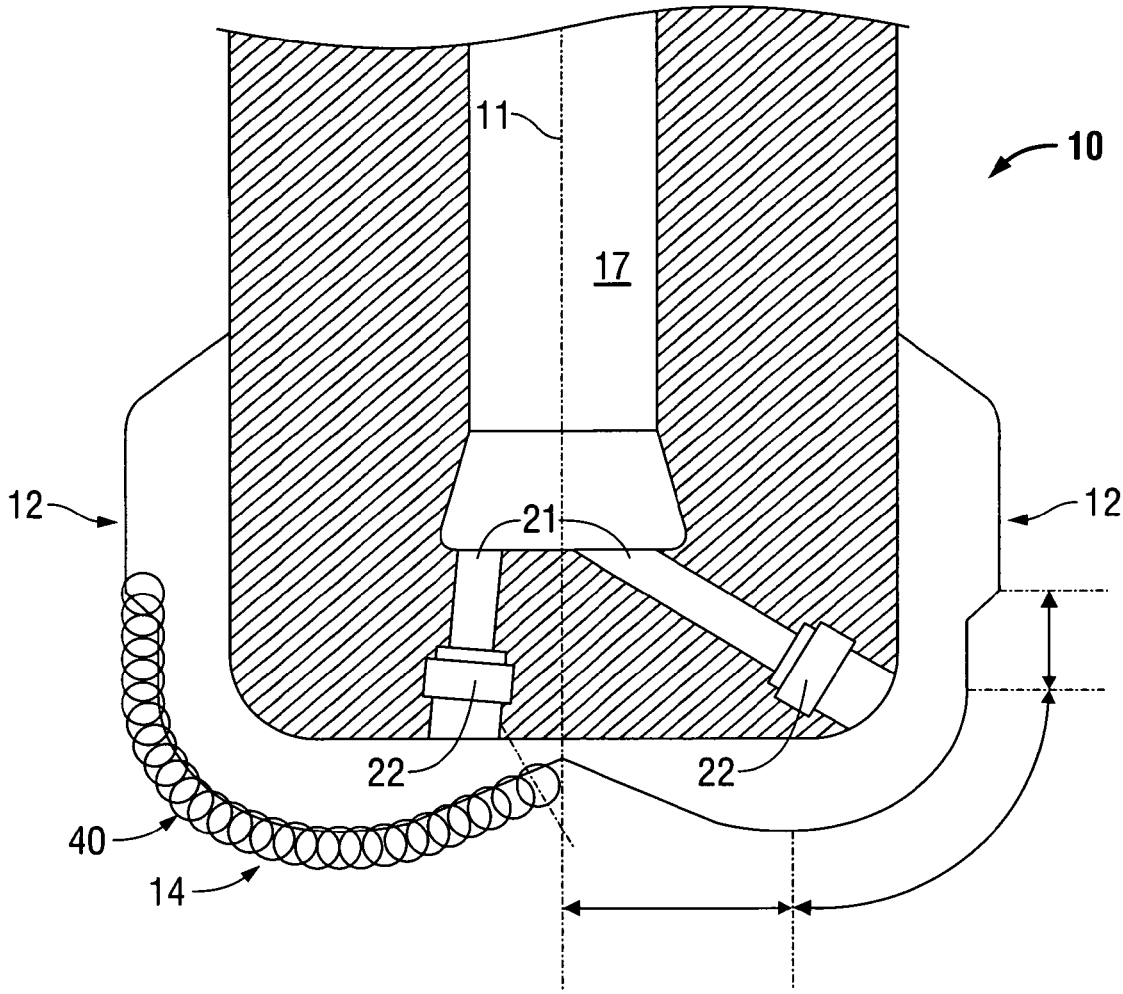
FIG. 2 (Prior Art)
FIG. 2 is a cutaway, schematic illustration of the prior art drill bit illustrated in FIG. 1.
Figure 5A:
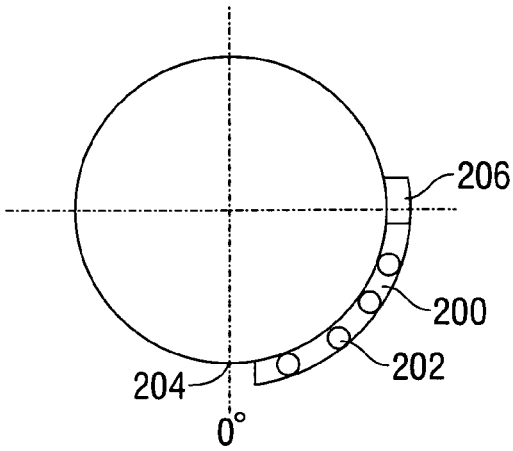
FIG. 5A (Prior Art)
FIG. 5A is a schematic view of a drill bit known in the prior art illustrating the spatial relationship between a gage wear pad and a cutter blade having PDC cutter elements mounted therein.

FIG. 5A is a schematic representation of the use in the prior art, such as for example the prior art drill bits illustrated in FIGS. 1 and 2, of the orientation of a cutter blade 200 having a plurality of PDC cutter elements 202, in which the cutter blade 200 commences essentially at the center point of the bottom cutting face of the bit 204 and terminates up against the wear pad 206.

Figure 5B:
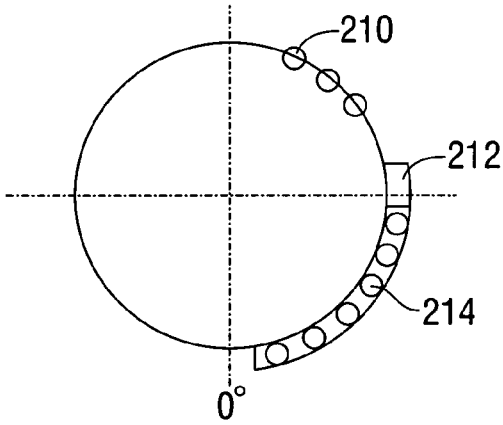
FIG. 5B (Prior Art)
FIG. 5B is a schematic view of a drill bit known in the prior art illustrating the spatial relationship between a gage wear pad and a cutter blade having PDC cutter elements mounted therein, and having one or more back reaming cutters on the opposite side of the gage wear pad.

FIG. 5B is similar to the prior art drill bit schematic of FIG. 5A but has in addition thereto one or more PDC cutter elements 210 but which are only used in the prior art when pulling the drill bit out of a wellbore to provide help in the reaming of the wellbore. Just as in the prior art of FIG. 5A, the wear pad is located at the 90° point on the curvature so that the PDC cutter elements 214 are the only cutter elements involved in the cutting of the borehole.

Figure 5C:
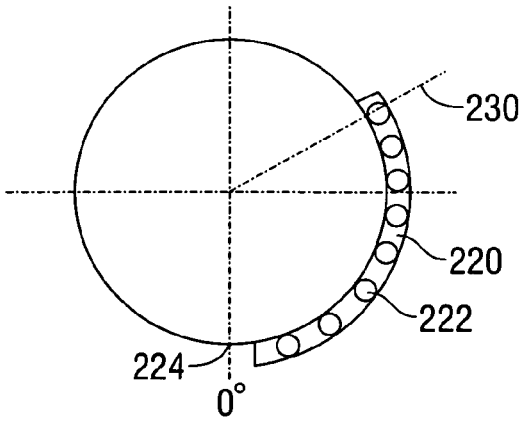
FIG. 5C is a schematic view of a drill bit according to an embodiment of the present invention illustrating the spatial relationship between the cutter blade having PDC cutter elements mounted therein.

FIG. 5C is a schematic representation of the drill bit in accordance with the present invention in which the cutter blade 220 commences at near the center part of the bit 224 but terminates well past the 90° point of the curvature on the FIG. 5C. The blade 220 with attached PDC cutter elements extends up to the dotted line 230 which may be of various angles, all of which are greater than 90° but for example can be at a point greater than 100°, or greater than 115°, only as limited by the proximity of the cutter blade 220 and attached PDC cutter elements 222 as discussed hereinabove to the location of the shank or the threaded pin discussed hereinabove. Although only one cutter blade 220 is discussed with respect to FIG. 5C, each of the cutter blades and the PDC cutter elements for each of those blades are contemplated to be just as discussed herein with respect to the cutter blade 220 and cutter elements 222.

The continuous path of cutter elements which terminate at or near the body of the drill bit will vary depending upon the threaded connection 52 which has dimensions typical of sizes recommended by API but will also vary with a size of the bit body as the continuum of the cutter elements 60 on each of the blades approaches the bit body as illustrated in FIG. 3. The cutting radius used in the present invention will preferably be a greater angle than 90° but will vary depending upon the dimensions of the bit body and the threaded pin illustrated in FIG. 3. While the number of blades as illustrated in FIG. 4 is six, those in this art know that the number of blades can be any plurality which can be used on bits as desired.

Figure 8:
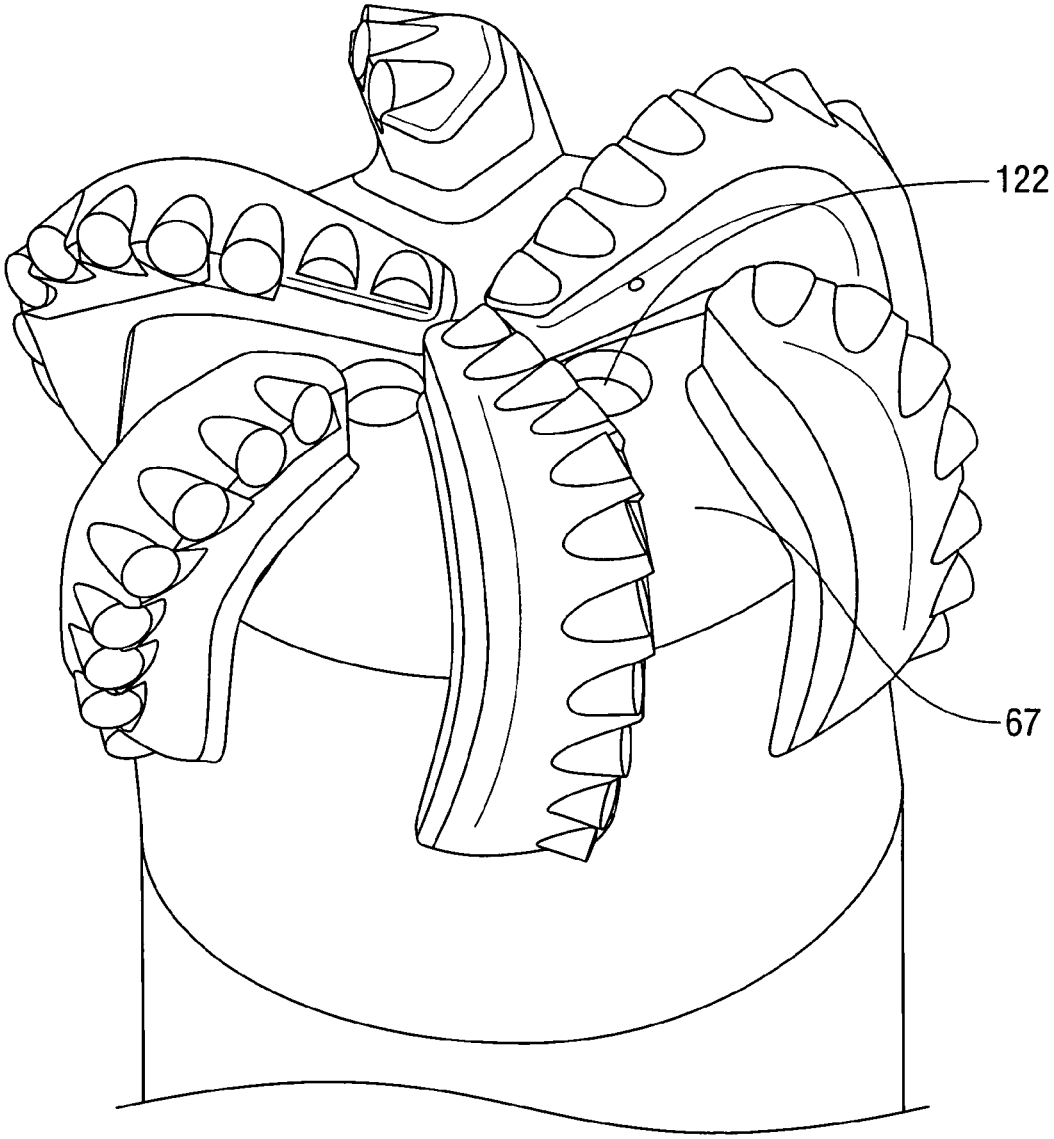
FIG. 8 is another pictorial view of the drill bit of FIGS. 3 and 4.

It should be appreciated that the illustration of FIGS. 3 and 4 do not show the nozzles such as the nozzles 22 of FIG. 2, but the nozzles in practice will exit from the bottom face 67 illustrated in FIG. 4. The nozzles 122, corresponding to nozzles 22 of FIG. 2, are illustrated in FIG. 8 of the drill bit according to the present invention.

Figure 6:
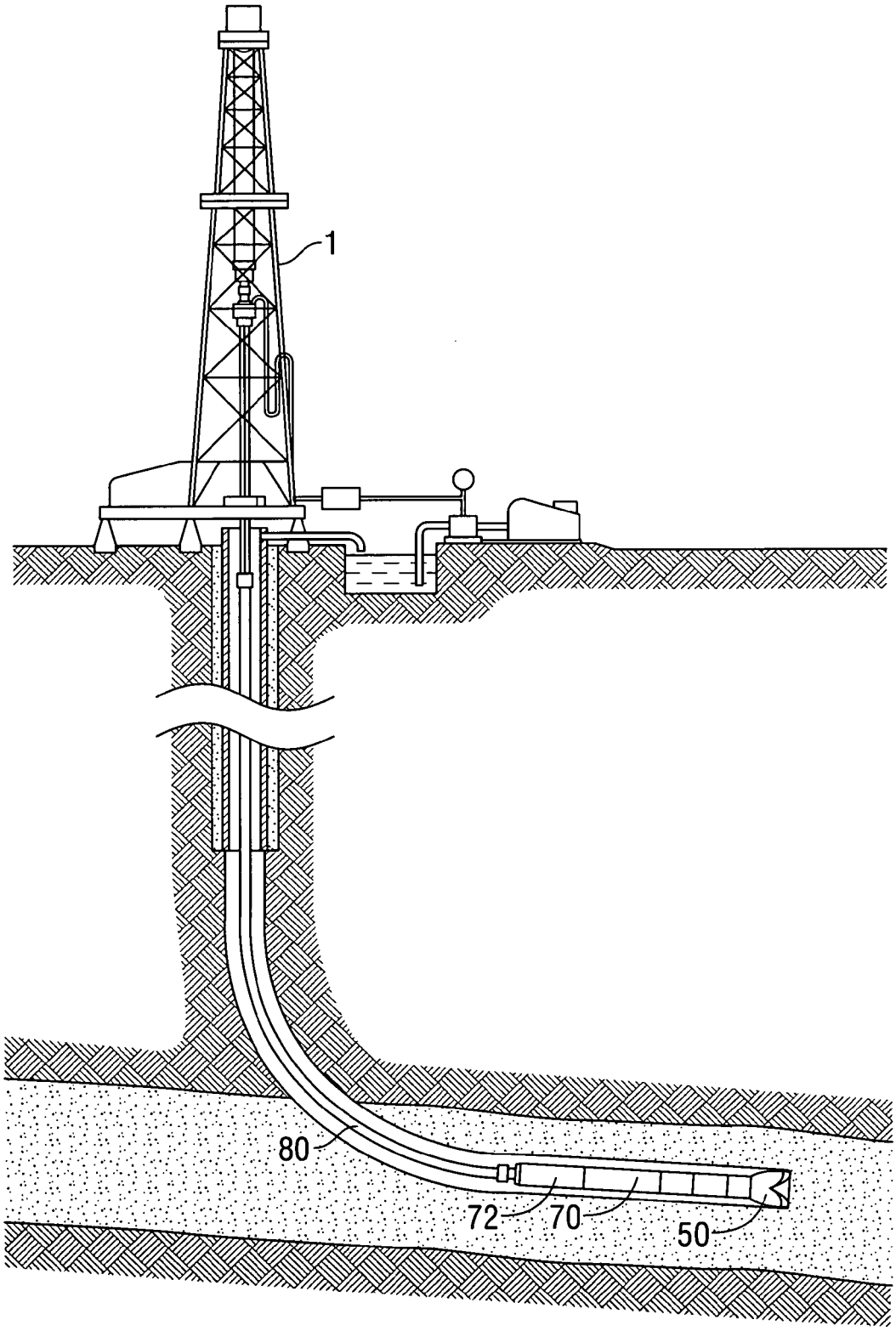
FIG. 6 is an elevated view, partly in cross section, of a directional wellbore being drilled with a drill bit according to an embodiment of the present invention.

Referring now to FIG. 6, there is illustrated the use of the drill bit 50 with a drill string 80 which uses a steerable motor 70 which may or may not have a "bend" 72 as is known in this art. As is well known in this art, it is sometimes easy enough to drill the borehole through a big angle as illustrated in FIG. 6 but harder sometimes to have the steel casing to be used in the borehole go past that same bend in the borehole. Due to the cutter configuration in FIGS. 3 and 4, cutter elements 63 and 65 may be used by pulling up on the drill string to smooth out the rough corner which would otherwise be found in the angled borehole such as in FIG. 6, thus smoothing a way for the placement of steel casing within the borehole.

It is well known in the art of directional drilling that there are two major types of rotary steerable systems. First of all, there is an orientation system, typically having two bends, which enables the drill string to be rotated to a certain orientation, generally as determined by the geologist having knowledge of the formations containing oil, gas or some other valuable commodity. The second system involves the pushing of the drill string laterally away from its existing location. This system is commonly referred to as a "pusher" rotary steering system. While pushing the drill string in the given direction, the drill bit 50 may be rotated by a motor, such as the motor 70. Because of the orientation of the cutter elements such as are illustrated in FIG. 3, the drill bit 50 will actually drill sideways, i.e., in a determined lateral direction. Once the drill bit 50 is in the proper location while being pushed, the pusher phase can be discontinued, and the motor 50 can continue to be rotated by the motor 70 and the desired drill path, generally downward, can continue. These pusher rotary steerable systems are known in the art and need not be described here in any detail. This lateral drilling activity is not believed to be known in the prior art.

Thus it should be appreciated that, as discussed hereinabove, the drill bit can be pulled up by the drill string and thus act somewhat like a reamer to smooth out or to enlarge the borehole as desired.

The use of a pusher rotary steering system, while rotating the drill bit according to one or more embodiments of the present invention, allows the bit to drill laterally, i.e., sideways, while the drill string is being pushed laterally. This would be essentially impossible to do when the drill bit is inhibited from drilling overgage by gage wear pads because the gage wear pads would push against the sidewall of the borehole and not allow any lateral cutting. In addition, the use of the cutter elements being spaced to give a cutting radius greater than 90° allows the drill bit to drill laterally. It should be appreciated that such a drill bit may be used with every known rotary steerable system presently in the marketplace.

Figure 7:
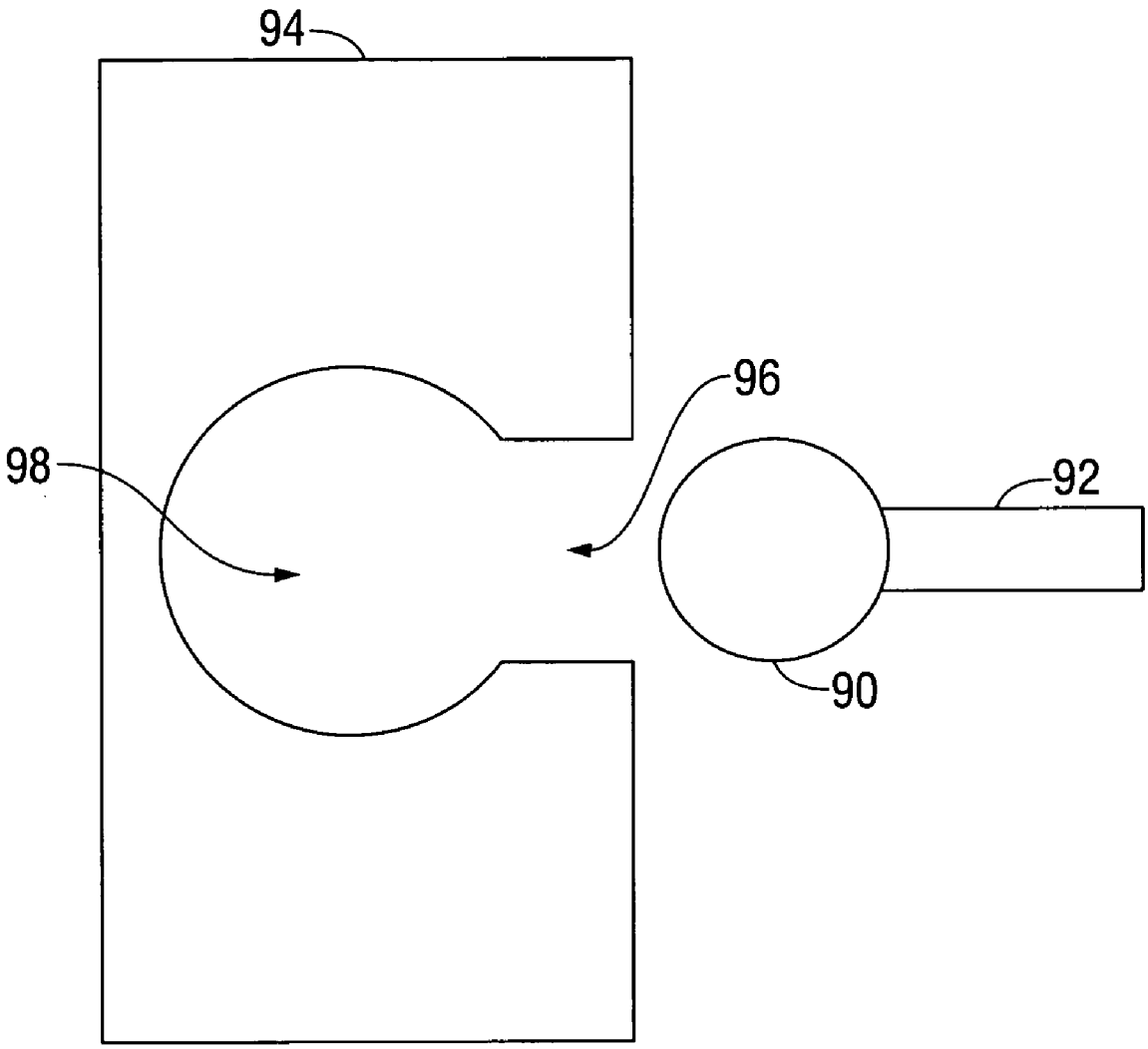
FIG. 7 is schematic illustration of the cutting of an external reentrant profile.

An additional feature of this invention is the fact that a drill bit in accordance with one or more embodiments of the present invention can provide an externally reentrant profile. That feature is achieved because such a drill bit may be similar, in some respects, to a round or ball end mill used in machining but which is not used in the manufacture and use of drill bits. The principle of external reentrant profiling is illustrated in FIG. 7 in which a solid block of concrete or other drillable material is penetrated by a round or ball end mill 90 having a driving stem 92, which first penetrates the concrete block 94 creating an entrance portal 96. Once the round or ball end mill 90 reaches the central region of the concrete block 94, the stem 92 can be moved up or down or around to cause the rounded out opening 98. This is all accomplished by the fact that the mill 90 can cut out any portion of the concrete against which it is moved by the rotation of the stem 92. This is somewhat analogous to the drill bit 50 in the embodiment illustrated in FIG. 3 having no wear gage pads to resist the cutting into the sidewalls of the borehole and which can be caused to cut into any section of the sidewall of the borehole and thus cause an enlarging of one side or the other of the borehole such as done with respect to the illustration in FIG. 7. Drill bits according to one or more embodiments of the present invention may be used to increase the cutting radius well beyond the 90° cutting radius typical of prior art drill bits having either gage wear pads or some other dedicated gage retention mechanism, providing a marked improvement in the art of drilling directional wellbores.

The invention claimed is:

1. A drill bit for drilling an earth borehole, the drill bit comprising:

a bit body comprising a first end, a second end, an outer diameter, and a bit face, said bit face comprising a plurality of cutters disposed thereon, wherein said plurality of cutters define a continuous cutting surface extending substantially from the first end to the second end, and wherein at least one of said cutters extends beyond the outer diameter of the bit body for providing the earth borehole with a diameter greater than the outer diameter of the bit body to facilitate directional steering of the drill bit.

2. The drill bit according to claim 1, wherein an outermost cutter of the plurality of cutters and an innermost cutter of the plurality of cutters are angularly displaced from each other by an angle greater than ninety degrees.

3. The drill bit according to claim 1, wherein the bit face comprises a plurality of blades extending therefrom, the plurality of cutters being disposed generally in rows on said plurality of blades.

4. The drill bit according to claim 1, wherein one or more of said cutters of the plurality of cutters comprises at least one blade having PDC cutting elements affixed thereon.

5. The drill bit according to claim 1, wherein at least one of the cutters of said plurality of cutters is oriented to bore in a generally axial direction, wherein at least one other of the cutters of said plurality of cutters is oriented to bore in a generally lateral direction, and wherein said at least one other of the cutters oriented to bore in the generally lateral direction bores in the generally lateral direction while the drill bit is urged in the generally axial direction within the earthen borehole to provide the diameter to the earthen borehole.

6. The drill bit according to claim 1, wherein at least one of the cutters of said plurality of cutters is oriented to bore in a generally axial direction, wherein at least one other of the cutters of said plurality of cutters is oriented to bore in a generally lateral direction, and wherein said at least one other of the cutters bores in the generally lateral direction under application of a lateral force in said generally lateral direction to directionally steer the drill bit.

7. A drill bit for drilling an earth borehole, the drill bit comprising:

a bit body comprising a first end, a second end, an outer diameter, and a bit face, said bit face having a plurality of cutters defining a continuous cutting surface extending substantially from the first end to the second end, wherein at least one of the cutters is oriented to bore in a substantially axial direction and at least one other of the cutters is oriented to bore in a substantially lateral direction while the drill bit is urged in the substantially axial direction.

8. The drill bit according to claim 7, wherein said cutters provide a cutting radius in excess of ninety degrees.

9. The drill bit according to claim 7, wherein at least one of said cutters provides an oversize borehole when drilling.

10. The drill bit according to claim 7, wherein at least one of said cutters causes said drill bit to drill in a lateral direction when provided with a lateral force.

11. The drill bit according to claim 7, wherein the bit face comprises a plurality of blades extending therefrom, one or more of the blades bearing a plurality of cutter elements being disposed generally in rows on said plurality of blades and defining the continuous cutting surface extending substantially from the first end to the second end of the bit body.

12. The drill bit according to claim 7, wherein one or more of said cutters of said plurality of cutters comprises at least one blade having PDC cutting elements affixed thereon.

13. A method for changing the direction of a drilled earth borehole, the method comprising the steps of:

exerting a lateral force on at least a portion of a drill string comprising a drill bit and an outer diameter in a lateral direction, wherein the drill bit comprises a bit body comprising a first end, a second end, an outer diameter, and a bit face, said bit face having plurality of cutters disposed thereon, wherein said plurality of cutters define a continuous cutting surface extending substantially from the first end to the second end, and wherein at least one of said cutters extends beyond the outer diameter of the drill bit for providing the drilled earth borehole with a diameter greater than the outer diameter of the drill bit to facilitate directional steering; and rotating the drill bit while said lateral force is being exerted, thereby causing at least a portion of said plurality of cutters to drill in said lateral direction without removing the drill bit from the drilled earth borehole, wherein the diameter of the drilled earth borehole facilitates movement of the drill bit in said lateral direction.

14. The method according to claim 13, wherein at least one of the cutters of said plurality of cutters is oriented to bore in a substantially axial direction and at least one other of the cutters of said plurality of cutters is oriented to bore in a substantially lateral direction.

15. The method according to claim 13, wherein one or more of said cutters of said plurality of cutters comprises at least one blade having PDC cutting elements affixed thereon.

16. A method for drilling an oversize borehole, the method comprising the steps of:

providing a drill bit comprising a bit body comprising a first end, a second end, an outer diameter, and a bit face, said bit face having a plurality of cutters disposed thereon wherein said plurality of cutters define a continuous cutting surface extending substantially from the first end to the second end of the bit body, wherein at least one cutter is oriented to bore in a lateral direction while the drill bit is urged in an axial direction within the borehole; and rotating said drill bit such that the at least one cutter bores laterally within the borehole while urging the drill bit in the axial direction, thereby providing the borehole with an oversize diameter.

17. The method according to claim 16, wherein at least one of the cutters of said plurality of cutters is oriented to bore in a substantially axial direction and at least one other of the cutters of said plurality of cutters is oriented to bore in a substantially lateral direction.

18. The method according to claim 16, wherein one or more of said cutters of the plurality of cutters comprises at least one blade having PDC cutting elements affixed thereon.

19. A drill bit for drilling an earth borehole, the drill bit comprising:

a bit body having a first end, a second end, a bit face, a longitudinal axis, and an outer diameter; and a plurality of cutters extending from the bit face in a plurality of continuous rows to define a continuous cutting surface extending substantially from the first end to the second end, wherein each of said plurality of continuous rows extends substantially from the first end to the second end of the bit body and generally parallel to the longitudinal axis, wherein at least one of the cutters of said plurality of cutters is oriented to bore in a substantially axial direction relative to the longitudinal axis, wherein at least one other of the cutters of said plurality of cutters is oriented to bore in a substantially lateral direction relative to the longitudinal axis, and wherein said at least one other of the cutters extends beyond the outer diameter of the bit body for providing the earth borehole with a diameter greater than the outer diameter of the bit body to facilitate directional steering of the drill bit and to enable drilling of the earth borehole in the substantially lateral direction under application of a lateral force.

* * * * *